United States Patent [19]

Summers et al.

[11] 4,216,080

[45] Aug. 5, 1980

[54] METHOD AND APPARATUS FOR SEPARATING SAND FROM BOTANICAL FINES

[75] Inventors: Thomas W. Summers, Fern Creek; Earl E. Kohnhorst, Louisville, both of Ky.

[73] Assignee: Brown & Williamson Tobacco Corporation, Louisville, Ky.

[21] Appl. No.: 7,109

[22] Filed: Jan. 29, 1979

Related U.S. Application Data

[63] Continuation of Ser. No. 623,886, Oct. 20, 1975, abandoned.

[51] Int. Cl.[2] ..... B03B 4/00

[52] U.S. Cl. ..... 209/469; 209/486; 209/502

[58] Field of Search ..... 209/315, 318, 311, 319, 209/321, 332, 402–405, 17, 44, 36, 37, 28, 29, 138, 139 R, 154, 158, 424, 426, 454, 456, 467, 469, 486

[56] References Cited

U.S. PATENT DOCUMENTS

| | | | |
|---|---|---|---|
| 2,068,783 | 1/1937 | Wendell | 209/44 |
| 2,245,942 | 6/1941 | Stump | 209/486 X |
| 2,678,131 | 5/1954 | Dore | 209/486 X |
| 3,842,978 | 10/1974 | Summers | 209/469 |

OTHER PUBLICATIONS

Summers, "Fluid Bed Separation of Tobacco Dust from Sand and Dirt," Tobacco International, Jan. 10, 1975, pp. 22–27.

*Primary Examiner*—Ralph J. Hill

*Attorney, Agent, or Firm*—Charles G. Lamb; William J. Mason

[57] ABSTRACT

A mixture of botanical fines and sand is separated by a porous separating medium horizontally disposed within an enclosed chamber in which an upflowing stream of gas carries out the separation. The porous separating medium is comprised of a plurality of particles constrained in a close-packed array between two opposed retaining members. While the gas flows up through the array of particles they are subjected to vibration, the separation being primarily determined by the flow of gas through the array and mobility of the particles. The separation is primarily controlled by altering the volume constraining the particles in the array which affects both the velocity of gas flow and the mobility of the particles.

23 Claims, 6 Drawing Figures

METHOD AND APPARATUS FOR SEPARATING SAND FROM BOTANICAL FINES

This is a continuation of application Ser. No. 623,886, filed Oct. 20, 1975, now abandoned.

BACKGROUND OF THE INVENTION

The present invention relates to separating particulate materials by placing such materials on a porous member while passing gas up through the porous member. One component of the mixture passes down through the porous member, the other component is entrained in the gas flow through the device and transported therefrom.

The mass production techniques used to handle various botanical materials for the manufacture of products using such materials generates a substantial amount of waste. In an industry such as the tobacco industry, where the botanical component of the product is increasingly expensive, there has been a long standing search for a means to separate undesirable components that are unintentionally introduced to the botanical material during handling and manufacture. Due to the significantly different physical properties of botanical materials and such undesirable components such as sand, most separation processes are designed to utilize such differences in properties.

One method of separating the components of such a mixture is to utilize the different absorption characteristics of the two components in a heavy liquid medium. Techniques of this type are somewhat limited in that there must be a subsequent separation of the desired botanical material from the medium effecting the separation. Where the medium carrying out the separation is a liquid, a further consideration must be made as to the effect of the liquid medium on the botanical material. Furthermore, the separation of the botanical material from a liquid may be relatively complex.

U.S. Pat. No. 3,842,978 teaches an apparatus where botanical materials are separated from sand by their different response to a flowing air stream passing through a vibrating array of particles. The separation of the botanical material from the sand in such devices is carried out on a porous array having a flowing stream of gas passing up through the array. Therefore, the separation is primarily controlled by the configuration and packing density of particles comprising the array and the velocity of gas passing therethrough. Use of such prior art devices has resulted in experience whereby the packing density and hence the response of the particles within the array to the vibration changes over a period of time thereby changing the separation performance of the device. There being no practical means of changing the packing of the particles within the array other than physical insertion of particles to the array, the change in operation must be compensated by changes in the velocity of the gas passing through the array or by other relatively ineffective control variables. The physical insertion of particles into the array is disruptive of the separation process requiring the equipment to be partially disassembled.

By contrast, the present invention provides means of changing the density of packing of the particles within the array both to allow compensation for changes in the packing over a period of time and to allow changes in the array necessitated by the introduction of a mixture of botanical materials and undesirable particles of different size characteristics. The nature of the separation process in the specifically cited prior art and the present invention relies on the response of the materials to a flowing air stream. Such a response is dependent on the configuration and size of the particles comprising the mixture. The prior art having no convenient means of altering the packing of the array could not, therefore, be readily adjusted in response to different configurations and sizes of material input. While the gas velocity through the apparatus may be used to make such adjustments, it is interrelated with other characteristics of the device, namely the transport of the botanical materials to a subsequent separating means. The adjustment of the separating process by altering the gas flowing through the apparatus is undesirable.

Therefore, it is the main object of the present invention to separate botanical materials from undesirable particles contained therein whereby changes in the characteristics of the mixtures introduced to the apparatus can be effectively accommodated by adjustments of the porous array carrying out the separation.

A further object of the present invention is to provide a means of adjustment of the separation characteristics of such an apparatus without direct adjustment of the gas flow.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

SUMMARY OF THE INVENTION

To achieve the foregoing objects and in accordance with the purposes of the invention, as embodied and broadly described herein, the apparatus for separating the components of a mixture of sand and botanical fines comprises a substantially enclosed chamber having an opposed pair of porous retaining members horizontally disposed within it. A plurality of particles are arranged in a close-packed array between the two retaining members and means are provided for changing the density of packing of the particles. Means for vibrating the particles within the array are provided as well as means for introducing the mixture into the chamber above the array. A moving stream of gas is passed up through the chamber and the array toward the mixture of sand and botanical materials within the chamber and means are provided downstream from the array in flow communication with the chamber for collecting the botanical fines separated from the mixture.

Preferably, the particles comprising the array are substantially spherical. It is also preferred that the chamber be substantially cylindrical with the means for adjusting the retaining members each including a radially disposed flange. A cylindrical support member comprising a portion of the chamber has an outside diameter slightly greater than the outside diameter of the interior portion of the retaining members. The support member has a depth sufficient to contain a number of rows of the particles in the array and includes a pair of opposite, radially disposed flanges affixed to the support member disposed to align with the radially disposed flange on the retaining members. The flanges on the retaining members and the support members align to form pairs of flanges with a deformable means disposed between the pairs of flanges. Means for drawing aligned pairs of flanges toward each other are provided and thereby provide means for altering the space between the retaining members resulting in a change in the volume confining the particles and thereby the packing density and mobility of the particles therein.

The method of separating the components of the mixture containing sand and botanical fines comprises the constraining of the plurality of the particles as a close-packed array between a pair of horizontal porous retaining members within an enclosed chamber. The mixture is placed within the chamber on the upper porous retaining member of the pair. While the array is vibrated, a moving stream of gas passes up through the array toward the mixture on its upper surface. The space between the pair of porous retaining member is altered, altering the volume confining the particles and thereby the packing of the particles within the array. The sand moves downward through the array while the botanical components move upward in the stream of gas. The botanical fines are thereafter collected downstream from the array of particles.

BRIEF DESCRIPTION OF THE DRAWINGS

The invention consists in the novel parts, constructions, arrangements, combinations and improvements shown and described, the accompanying drawings which are incorporated in and constitute a part of the specification illustrate one embodiment of the invention and together with the description, serve to explain the principles of the invention.

Of the Drawings.

DESCRIPTION OF THE PREFERRED EMBODIMENT

Figure 1:
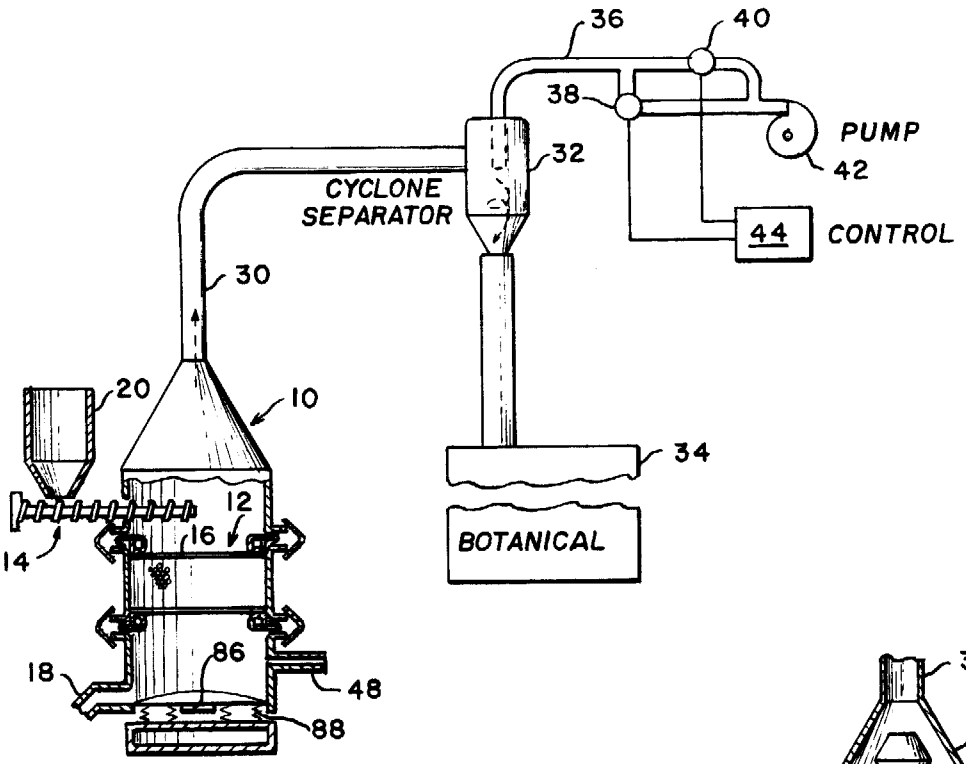
FIG. 1 illustrates an embodiment of the invention to be employed in the separation of botanical mixtures from undesirable particulate materials.

Referring now to FIG. 1 where the complete apparatus for separating botanical materials from sand is disclosed. As here embodied, a chamber 10 is provided to enclose a separating medium 12 onto which the mixture of botanical materials and sand is placed. A screw conveyor 14 introduces such materials to the upper surface 16 of the separating medium 12. As indicated by the upper arrow, gas flow through the chamber enters the bottom of the separating medium 12 and exits as the top of chamber 10. Sand in the mixture exits the bottom of the separating medium 12 through spout 18.

The mixture of sand and botanical material is introduced to the screw conveyor 14 by means of the hopper 20. The botanical material entrained in the gas flow exiting the chamber 10 passes through the conduit 30 into means for separating the botanical material from the air stream here embodied as a cyclone separater 32. The botanicals are then retained in container 34 with the air stream further passing through conduit 36 to means for controlling the air flow through the device.

As here embodied, the means for controlling the air flow includes two valves 38 and 40 with an associated pump 42. Control means 44 interacting with the valves 38 and 40 control the air flow to the pump 42. The control means may be disposed to provide constant or variable air flow through the device with constant air flow being preferred.

The advantages of the particular configuration of botanical handling equipment downstream from the chamber 10 is adequately described in the specifically cited prior art.

Figure 2:
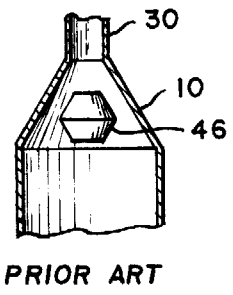
FIG. 2 is a partial cross-section of the chamber of FIG. 1 illustrating a prior art component of the chamber.

FIG. 2 depicts a prior art embodiment that is also applicable to the present invention. As here embodied, the improvement comprises a flow deflection means 46 downstream from the array of particles forming the separating means 12. The flow deflection means increases the gaseous flow rate in the apparatus downstream from the flow deflection means 46.

The present invention comprises a means for separating the components of a mixture of sand and botanical fines comprising the system depicted in FIG. 1.

In accordance with the invention, a substantially enclosed chamber is provided. As here embodied and best depicted in FIG. 1, the chamber 10 is cylindrical and is in flow communication with means for inducing gas flow therethrough. The chamber 10 is essentially gas-tight with the exception of the inlet 48 into which gas is drawn through the chamber 10 into the conduit 30. In order to maintain the air-tight feature of the chamber, the means for introducing the mixture to the chamber should be sealed. As here embodied, the screw feed 14 passing one sidewall of the chamber 10 would preferably have sealing means preventing significant gas flow around and through the screw feeder 14 into the chamber 10. Likewise, when operating, the level of sand and tobacco mixture should be maintained in hopper 20 to prevent shunting of air flow through screw conveyor 14.

Figure 3:
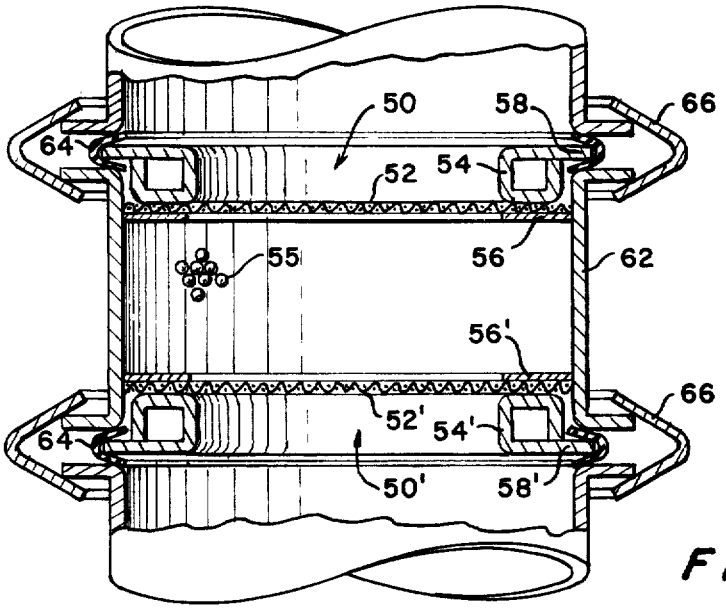
FIG. 3 is a partial cross-section of an embodiment of the invention illustrating one means of altering the space between the two porous retaining members confining the array of particles through which the gas flows.
Figure 4:
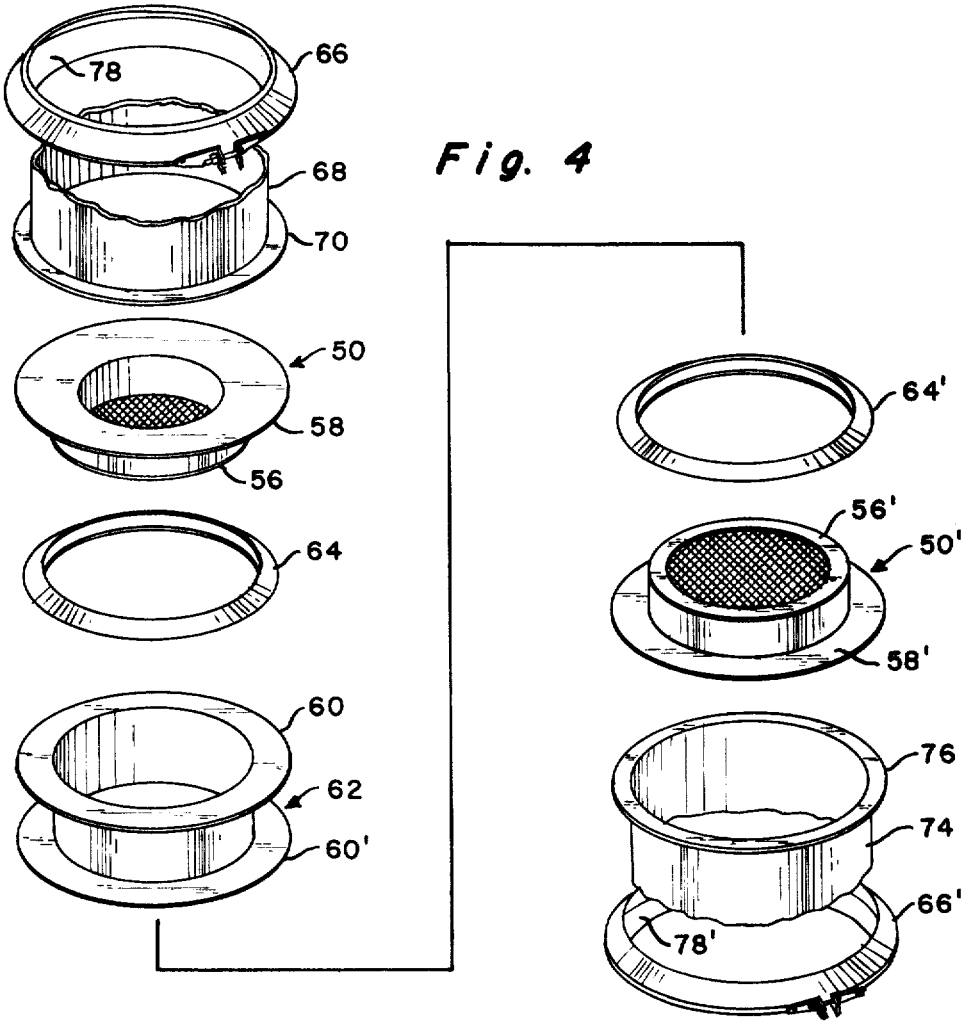
FIG. 4 is an exploded view of the embodiment of FIG. 3.

In accordance with the invention, an opposed pair of porous retaining members are horizontally disposed within the chamber. As here embodied and best depicted in FIGS. 3 and 4, the porous retaining members 50 are comprised of a screen 52 affixed to a peripheral ring 54. The screen 52 is affixed to the ring 54 in such a manner that force applied to the ring 54 will be affectively transmitted through particles 55 in contact with the screen 52 without buckling or bending the screen. As here embodied, circumferential rings 56 are welded to the screen 52 and the peripheral ring 54.

It is the function of the screens 52 and 52' to constrain a plurality of particles 55 between the two retaining members and transmit forces applied to the retaining members to the particles therebetween. Since gas passes through the retaining members and the particles therebetween, the retaining members necessarily includes screens 52 and 52' that have a pore diameter less than that of the particles 55 contained therebetween. While the particles 55 are shown only partially filling the volume between screens 52 and 52', it should be noted that this volume is completely filled with particles in the actual invention.

In accordance with the invention, a plurality of particles in a close-packed array are placed between the retaining members. As here embodied and best depicted in FIG. 3, the particles 55 are constrained in a close-packed array between the two screens 52 and 52'. While the particles are depicted to be spherical and spherical particles are preferred, the invention is operable with non-spherical particles. It is further preferred that where the particles 55 are spherical, the particles have a diametric tolerance of ±20 percent. It is also preferred that the spherical particles have a diameter in the range of from 0.5 to 5 millimeters.

While the particles are preferably spherical and spherical particles provide a more uniform pore structure, other shapes may be used within the invention. For purposes of the invention, substantially spherical particles are those particles that can be packed in a manner that the pores therebetween are of sufficient uniformity and size that an effective separation of the mixture can be accomplished. Specific examples of the operable but not preferable particle shapes would be granular particles, spherical particles with projections thereon, elliptical particles, etc.

The present embodiment has shown particular success in separating tobacco-sand mixtures having a particle size larger than would pass through a 100 mesh screen. In view of this characteristic of the invention, the mixture introduced to the hopper 20 may be subjected to a preclassifying separation to remove particles having a diameter smaller than would be retained on a 100 mesh screen.

Since the sand components of the mixture are intended to pass through the array of particles, where the particles are spherical, it is desired that the largest sand particles in the mixture do not exceed approximately 18 percent of the diameter of the spherical particles. When the sand and spherical particles have such a relationship, it has been found that the sand particles move relatively freely through the particle array to be ultimately discharged at the bottom portion of the chamber.

Particular success has been experienced in the operation of the device when the array of spherical particles within the retaining members is seven rows deep. The preferred depth of the array provides a compromise between the resistance of passage of the botanical materials through the array and the rate at which the apparatus can effectively separate the botanical components of the mixture. Increasing the depth of the array of spherical particles, in general, increases the selectivity of the apparatus to make the separation. However, it simultaneously reduces the rate at which the separation can take place.

In accordance with the invention, means are provided for adjusting the volume constraining the particles in order to change the density of packing of the particles within the array. As embodied and depicted in FIGS. 3 and 4, the means for adjusting the space between the retaining members 50 comprises a pair of peripheral rings 54. The peripheral rings include radially disposed flanges 58 and 58'. The flanges 58 interact with flanges 60 and 60' on a cylindrical support member 62 comprising a portion of the chamber 10. The support member 62 has a depth sufficient to contain a number of rows of the particles 55. The flanges 60 on the support member 62 are affixed to the support member and are disposed to align with the radially disposed flanges 58 and 58' on the retaining member 50 to form an aligned pair of flanges.

Preferably, deformable means 64 are disposed between the opposite aligned pairs of flanges with means provided for drawing the opposite aligned pairs of flanges toward each other. A cylindrical column member 68 is positioned above the uppermost porous retaining member 50. Flanges 70 affixed to the column member 68 are disposed to align with radially disposed flanges 58 and 60 and deformable member 64. A cylindrical discharge member 74 is positioned below the lowermost porous retaining member 50. Flanges 76 affixed to the column member 74 are disposed to align with radially disposed flanges 58' and 60' and deformable member 64'. As here embodied in FIGS. 3 and 4, the means for drawing the pairs of flanges toward each other are circumferential members 66 and 66' having a V-shaped internal surface 78 and 78' that encompasses the triple flanges 70, 58 and 60 and 60', 58' and 76, respectively. Preferably, the members 66 and 66' includes means for adjusting the depth of engagement of the internal surface 78 in relation to the flanges 70 and 60 and 60' and 76, respectively.

Figure 5:
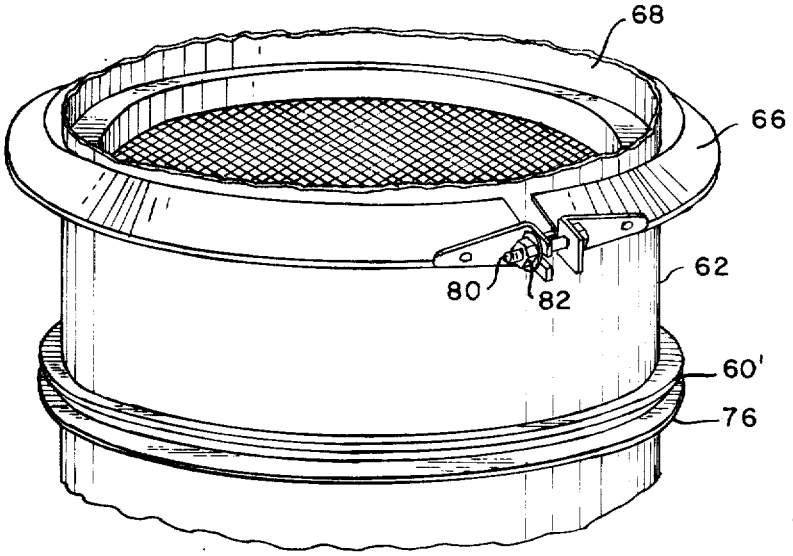
FIG. 5 is a partially assembled view of the components of FIG. 3.

As here embodied and most clearly depicted in FIG. 5, the means of adjusting the depth of engagement of the internal surface 78 in relation to the flanges comprises a means for changing the length of the circumferential member 66. As here embodied, the means of changing the length of the circumferential member 66 is a threaded fastener 80 affixed to the member 66 with an associated threaded nut 82. The engagement of the nut 82 on the fastener 80 changes the length of the circumferential member 66 and hence the depth of engagement of the flanges encompassed therein.

In accordance with the invention, the means for reducing the volume constraining the particles need not be solely the vertical movement of the retaining members 50.

Figure 6:
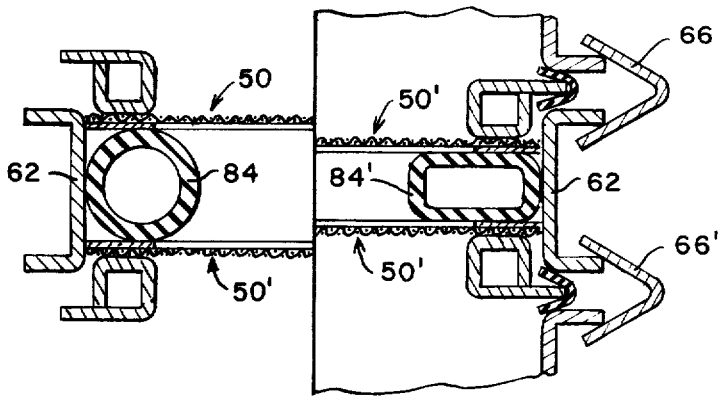
FIG. 6 is a cross-sectional view of another embodiment of the invention illustrating another means of altering the volume constraining the particles.

As here embodied and depicted in FIG. 6, the volume constraining the particles is reduced by reducing the internal diameter of the constraints. In the embodiment of FIG. 6, the vertical movement of the retaining members 50 and 50' deforms the circumferential member 84 to the configuration depicted by member 84' thereby reducing the diameter of the volume between the retaining members. While this embodiment reduces both the height and diameter of the volume constraining the particles simultaneously, one skilled in the art can devise means of adjusting the two dimensions independently.

As depicted in FIG. 1, the apparatus includes means for vibrating the chamber 10 and therein the array of particles. As here embodied, the vibrating means 86 is depicted schematically, being elastically attached to the chamber 10 by means of connections 88. The individual particles within the separating means 12, while in a close-packed array, are not always in static contact with the surrounding particles. The vibration of the array causes the particles to vibrate between the retaining members 50. The vibration of the array and the openings of the array due to vibration prevents the clogging of such an array by materials passing therethrough. Due to the vibration of the chamber, the means for introducing the mixture to the chamber should accommodate such vibration.

Preferably, the apparatus includes means for visually observing the discharge from lower retaining member 50' for the purpose of determining if the mixture is being effectively separated. The presence of botanical materials issuing from the lower retaining member would indicate that the packing density of the particles within the retaining members needs to be adjusted.

The Method of Operation

The present invention operates to separate the components of a mixture of sand and botanical fines in the embodiment depicted by constraining a plurality of particles 55 in a close-packed array between a pair of horizontal porous retaining members 50 and 50' within an enclosed chamber 10. The mixture of sand and botanical materials are placed within the chamber 10 above the upper porous retaining member of the pair. The array is vibrated by operation of the vibrating means 86 while passing a moving stream of gas up through the array toward the mixture on the array.

The space between the pair of porous retaining members 50 is adjusted to alter the packing of the particles within the array to separate the components, the sand moving downward through the array while the botanical components move upward in the stream of gas. The botanical fines are thereafter collected downstream from the array.

The preferred method of operating the present invention would have the particles be spherical and arranged in a 3-center close-packed configuration having the average diameter of the largest sand particle in the mixture less than 18 percent of the diameter of the spherical particles. When the method if carried out in this manner, the array is not clogged with sand and thereafter reduced in effectiveness due to the inability of larger particles of sand to be transported through the array during vibration.

While the gas flows through the array and velocity of the gas can be measured downstream from the array. the separation itself takes place within the array. The basic phenomena causing the separation is the fact that in a moving stream of gas, sand and botanical materials are transported at different rates. Therefore, the bulk flow rate of the gas through the array affects the separation process by affecting the local flow rate of gas around the particles within the array that interact with the botanical materials and sand within the array.

Preferably, a substantial portion of the gas within the array has a velocity in excess of the settling velocity of the botanical components of the mixture. Since the particles within the array are constantly moving, thereby opening and closing passages within the array, an effective measurement of the velocity operating on the particles is impossible. A practical means of determining if a substantial portion of the gas within the array has a velocity in excess of the settling velocity of the botanical component of the mixture is to observe the lower retaining member of the array. By adjusting the volume constraining the particles and observing the material issuing from the lower retaining member, the volume can be adjusted until substantially no botanical fines exit from the array at the lower retaining member.

The present invention has shown particular success in separating tobacco from sand, especially when the mixture of sand and tobacco has a size in the range of from 0.15 to 0.6 millimeters with the spherical particles having a diameter of approximately 3 millimeters and the gas having an estimated velocity within the array of 3½ ft/sec.

In such an embodiment, the present invention provides a means for separating a mixture of tobacco and sand whereby the apparatus making the separation can be effectively adjusted to compensate for differences in separation behavior of different mixtures introduced to the apparatus.

The invention has been disclosed in terms of a preferred embodiment and one skilled in the art can make modifications and changes thereto while still remaining within the scope of the invention as defined by the appended claims.

What is claimed is:

1. A method of separating the components of a mixture of sand and botanical fines comprising:

(a) constraining a plurality of particles as a close-packed array between a pair of spaced horizontal porous retaining members within an enclosed chamber;

(b) introducing said mixture into said chamber above the upper porous retaining member of said pair;

(c) vibrating said particles;

(d) passing a stream of gas upwardly through said array;

(e) removing botanical fines from said chamber above said array;

(f) removing sand from said chamber beneath said array; and, (g) adjusting the packing density of said particles in response to a change in the proportion of sand to botanical fines by changing the spacing between said spaced horizontal porous retaining members during operation to alter the gaseous flow paths through said array and prevent the passage of botanical fines through said array while allowing sand to pass therethrough.

2. The method of claim 1 wherein said particles are substantially spherical and said array is of a 3-center close-packed configuration and the average diameter of the largest sand particle is less than 18% of the diameter of said spherical particles.

3. The method of claim 2 wherein said array is seven rows deep.

4. The method of claim 2 wherein said mixture has a size in the range of from 0.15 to 0.6 millimeters, said spherical particles have a diameter of approximately 3 millimeters and said gas has a velocity of approximately 3.5 ft/sec within said array and said botanical fines are tobacco.

5. The method of claim 1 wherein the space between said opposed pair of retaining members and hence the velocity of said gas within said array is adjusted to obtain a velocity in excess of said settling velocity by compressing said array with said retaining members until substantially no botanical fines exit upstream from said array.

6. The method of claim 1 wherein a substantial portion of gas within said array has a velocity in excess of the settling velocity of the botanical component of said mixture.

7. The method of claim 1 wherein said botanical fines are tobacco.

8. An apparatus for separating the components of a mixture of sand and botanical fines comprising:

(a) a substantially enclosed chamber;

(b) an opposed pair of spaced porous retaining members horizontally disposed within said chamber;

(c) a plurality of particles in a close-packed array between said retaining members;

(d) means for vibrating said particles;

(e) means for introducing said mixture into said chamber above said array;

(f) means for passing a stream of gas upwardly through said array;

(g) means for removing botanical fines from said chamber above said array;

(h) means for collecting sand from said chamber beneath said array; and, (i) means for adjusting the packing density of said particles by changing the spacing between said spaced horizontal porous retaining members during operation to alter the gaseous flow paths through said array and the movement of said particles within said array, said means for adjusting the packing density includes a deformable circumferential member in contact with said particles for reducing the internal diameter of constraint of said particles upon deformation of said circumferential member.

9. The apparatus of claim 8 wherein said particles are spherical.

10. The apparatus of claim 9 wherein said spherical particles have a diametric tolerance of ±20 percent.

11. The apparatus of claim 10 wherein said spherical particles have a diameter in the range of from 0.5 to 5 millimeters.

12. The apparatus of claim 9 wherein the average diameter of the largest sand particle in sand mixture does not exceed 18% of the diameter of the spherical particles.

13. The apparatus of claim 10 wherein said array of spherical particles is seven rows deep.

14. The apparatus of claim 8 including flow deflection means downstream from said array, said flow deflection means increasing gaseous flow rate in said apparatus downstream from said array.

15. An apparatus for separating the components of a mixture of sand and botanical fines comprising:

(a) a substantially enclosed cylindrical chamber;

(b) an opposed pair of spaced porous retaining members horizontally disposed within said chamber;

(c) a plurality of particles in a close-packed array between said retaining members;

(d) means for vibrating said particles;

(e) means for introducing said mixture into said chamber above said array;

(f) means for passing a stream of gas upwardly through said array;

(g) means for removing botanical fines from said chamber above said array;

(h) means for collecting sand from said chamber beneath said array; and, (i) means for adjusting the packing density of said particles by changing the spacing between said spaced horizontal porous retaining members during operation to alter the gaseous flow paths through said array and the movement of said particles within said array, said means for adjusting said retaining member includes a pair of circular, radially disposed flanges on said retaining member, a cylindrical support member comprising a portion of said chamber, said support member having depth sufficient to contain a number of rows of said particles, a pair of opposite radially disposed flanges affixed to said support member and disposed to align with said radially disposed flanges on said retaining members to form, aligned pairs of flanges, deformable means disposed between opposite aligned pairs of said flanges, and means for drawing said opposite aligned pair of flanges toward each other.

16. The apparatus of claim 5 including flow deflection means downstream from said array, said flow deflection means increasing gaseous flow rate in said apparatus downstream from said array.

17. The apparatus of claim 15 wherein the means of drawing said pairs of flanges toward each other is a circumferential member having a V-shaped internal surface encompassing said pairs and means of adjusting the depth of engagement of said internal surface in relation to said flanges.

18. The apparatus of claim 17 wherein the means of adjusting the depth of engagement of said internal surface in relation to said flanges comprises means for changing the length of said circumferential member.

19. The apparatus of claim 15 wherein said particles are spherical.

20. The apparatus of claim 19 wherein said spherical particles have a diameteric tolerance of ±20%.

21. The apparatus of claim 20 wherein said spherical particles have a diameter in the range of from 0.5 to 5 mm.

22. The apparatus of claim 19 wherein the average diameter of the largest sand particle in said mixture does not exceed 18% of the diameter of the spherical particles.

23. The apparatus of claim 19 wherein said array of spherical particles is seven rows deep.

* * * * *